US006161772A

United States Patent [19]

Anfindsen

[11] Patent Number: 6,161,772

[45] Date of Patent: Dec. 19, 2000

[54] METHOD AND DEVICE FOR FEEDING A CONTROLLED VOLUME FLOW OF LIQUID TO A SPRAY NOZZLE

[75] Inventor: Ole Arnt Anfindsen, Sandnes, Norway

[73] Assignee: ABB Flexible Automation A/S, Bryne, Norway

[21] Appl. No.: 09/367,098

[22] PCT Filed: Nov. 26, 1997

[86] PCT No.: PCT/IB97/01481

§ 371 Date: Aug. 18, 1999

§ 102(e) Date: Aug. 18, 1999

[87] PCT Pub. No.: WO98/35761

PCT Pub. Date: Aug. 20, 1998

[30] Foreign Application Priority Data

Feb. 17, 1997 [SE] Sweden ..... 9700543-3

[51] Int. Cl.[7] ..... B05B 17/04

[52] U.S. Cl. ..... 239/71; 239/71

[58] Field of Search ..... 239/11, 71, 74, 239/101, DIG. 14, 75; 417/44.1–3

[56] References Cited

U.S. PATENT DOCUMENTS

| | | | |
|---|---|---|---|
| 4,585,169 | 4/1986 | Kinsey | 239/75 |
| 4,712,736 | 12/1987 | Bray et al. | 239/11 |
| 4,833,748 | 5/1989 | Zimmer et al. | 239/71 |
| 4,848,657 | 7/1989 | Hashimoto et al. | 239/11 |
| 4,992,952 | 2/1991 | Sasaki | 239/69 |
| 5,310,113 | 5/1994 | Cowgur | 239/71 |
| 5,704,546 | 1/1998 | Henderson et al. | 239/61 |
| 5,810,254 | 9/1998 | Kropfield | 239/61 |

FOREIGN PATENT DOCUMENTS

| | | |
|---|---|---|
| 0326510 | 2/1989 | European Pat. Off. . |
| 0408051 | 1/1991 | Germany . |
| 09029147 | 2/1997 | Japan . |

*Primary Examiner*—Andres Kashinkow
*Assistant Examiner*—Jorge Bocanegra
*Attorney, Agent, or Firm*—Pollock, Vande Sande & Amernick

[57] ABSTRACT

A device for feeding a controlled volume flow of liquid to a spray nozzle for automatic spray application. A conduit defines a flow path from a liquid source to the spray nozzle. A displacement pump type member is arranged in the conduit. A driver drives the displacement pump type member with the movable parts thereof with a speed determined by the actual volume flow through the conduit. Elements arranged in the conduit upstream of the displacement pump type member supply the flow of liquid through the conduit to the displacement pump type member and properly feed the liquid in the conduit. A valve is located in the conduit. A regulator regulates the volume flow through the conduit by regulating the throttling degree of the valve means. A first measurer measures the pressure of the flow in the conduit downstream of the displacement pump type member. A second measurer measures the pressure of the flow in the conduit upstream of the displacement pump type member. An arrangement compares the pressure values delivered by the two measurers and on the basis of this comparison controls the regulator to influence the valve for obtaining comparison pressure values corresponding to a volume flow predetermined by the choice of the speed of the movable parts of the displacement pump type member.

19 Claims, 2 Drawing Sheets

METHOD AND DEVICE FOR FEEDING A CONTROLLED VOLUME FLOW OF LIQUID TO A SPRAY NOZZLE

FIELD OF THE INVENTION

The present invention relates to a device for feeding a controlled volume flow of liquid to a spray nozzle for automatic spray application. The device includes a displacement pump type member arranged in a conduit defining a flow path from a liquid source to the spray nozzle. The member is arranged to be driven by driving means with movable parts of the driving means with a speed determined by an actual volume flow through the conduit. The present invention also includes a method for feeding a controlled volume flow of liquid to a spray nozzle for automatic spray application of the liquid.

BACKGROUND OF THE INVENTION

Devices and methods such as the present invention are utilized primarily when objects are spray painted in different ways. For the purpose of illuminating the invention and the problems to be solved thereby but not in any way restricting the invention, the case of spray painting carried out by a spray painting robot will hereinafter be discussed.

Automatic spray painting is used for obtaining a smooth paint finish with a paint layer homogeneously applied on an object it is very important to control the volume flow of paint to the paint nozzle with a high accuracy. For this reason, gear pumps have, until now, most often been used for feeding the paint in a conduit into a spray nozzle. This has surely resulted in highly precise control of the volume flow.

However, in some situations, the use of such pumps leads to inconveniences. There is a great need for saving paint so as to reduce the costs for the very spray painting. Also, the size of the arrangement of the gear pumps and the motors driving them needed to feed the flow of paint to the spray nozzle is generally too important and the weight thereof too high for locating an arrangement close to the spray nozzle, since this is placed on a part moving during the spray painting, such as at the end of a robot arm. This is a disadvantage, since there is a clear connection between the amount of the paint wasted and the distance between such a pump functioning as means for a regulated volume flow and the spray nozzle.

SUMMARY OF THE INVENTION

The object of the present invention is to provide a device and a method of the type referred to above, which provides a remedy to the above-described inconveniences of known devices and methods.

This object is, according to the invention, obtained by the fact that a device of the type defined in the introduction also includes means arranged in the conduit upstream of the displacement pump type member and adapted to supply the flow through the conduit to the member and take care of the proper feeding of the liquid in the conduit. A valve means is located in the conduit. A device according to the present invention also includes means adapted to regulate the volume flow through the conduit by regulating the throttling degree of the valve means. Furthermore, a device according to the present invention includes a first means adapted to measure the pressure of the flow in the conduit downstream of the displacement pump type member and a second means adapted to measure the pressure of the flow in the conduit upstream of the displacement pump type member. An arrangement is adapted to compare the pressure values delivered by the two measuring means and on the basis of this comparison control the regulating means to influence the valve means for obtaining comparison pressure values corresponding to a volume flow predetermined by the choice of the speed of the movable parts of the displacement pump type member.

By arranging the displacement pump type member only for adjusting the volume flow of liquid desired in the conduit but not for causing the feeding of the flow into the conduit, the displacement pump type member may be made very small and light and be driven by a small driving means with a low power output. As a result, it is possible to place this member determining the volume flow very close to the spray nozzle, also when this is arranged on, for example, a robot arm. The feeding of the volume flow through the conduit is caused by the supplying means, which may be located substantially further upstream, where it is not critical if it has a considerable size and weight.

The construction of the device according to the present invention does not make great demands on the accuracy through which such a means is able to create a certain volume flow. The displacement pump type member ensures in cooperation with the valve means, the regulating means of the valve and the comparison means a very exactly controlled volume flow to the spray nozzle.

By not using a displacement pump type member for real active feeding of the liquid in the conduit a problem connected to the use of gear pumps for water-borne paints being more frequently used is solved through the device according to the invention. This problem includes that the high sheering speeds generated in the gear pumps are not born by water-borne paints without causing formation of aggregates therein. The sheering forces upon the paint by displacement pump type member in the device according to the invention get considerably lower, so that a good painting result may be obtained through this device with mainly all types of water-borne paints. It will also be possible to feed liquids having very low viscosity with a high accuracy, which liquids cannot be pumped at any high accuracy by a normal gear pump.

According to a preferred embodiment of the invention the driving means is formed by a motor with adjustable speed for regulating the speed of the movable parts displacement pump type member and, thereby, the volume flow through the conduit through the influence of the comparison arrangement on the regulating means. An exact regulation of the volume flow of the liquid is in this way possible by simple means.

According to another preferred embodiment of the invention the displacement pump type member includes means adapted to tightly separate an inlet chamber and an outlet chamber of the displacement pump type member over a limited first distance of the movement of the movable parts and allow leakage between the chambers over a second distance of the movement of the movable parts between consecutive first distances. Thanks to the fact that the leakage is allowed the sheer forces applied on the liquid through the displacement pump type member will get even smaller and the sensibility of the device to the use of water-borne paints will be reduced further. The present invention also facilitates cleaning of the device when changing color by placing the displacement pump type member in the leakage position. With the displacement pump type member in this position, bulky bypass circuits otherwise required past a gear pump are avoided.

According to another preferred embodiment of the invention, the comparison arrangement is adapted to compare the pressure values delivered by the measuring means during tightness between the inlet and outlet chambers and to control the regulating means to influence the valve means so that these values get substantially equal. The pressure may be measured in this way on both sides of the displacement pump type member and the valve means controlled so that the difference between these pressure values comes to a minimum. The minimum corresponds to a volume flow predetermined by the adjustment of the speed of the movable parts of the displacement pump type member while leaving the flow substantially not influenced by the member.

According to another preferred embodiment of the invention the displacement pump type member has the general structure of a gear pump with at least two tooth-like wheels having two members mutually meshing. A displacement pump type member provided with this structure is suitable for being driven with an exactly adjustable speed. Also, this member can in this way be made very light, simple and unexpensive.

According to another preferred embodiment of the invention the first distances with tightness between the inlet and the outlet chambers are shorter than the distance between two consecutive tooth members of the respective wheel. Tightness and leakage possibility between the chambers may in this way easily be alternatingly achieved, so that the pressures measured have a pulsating appearance, in which it is advantageous to compare the pulse positions corresponding to tightness states with each other.

According to a preferred embodiment of the invention the distance with complete tightness corresponds to 25–40% of the tooth distance. This distance has turned out to be sufficient for obtaining good measurements for the comparison and achieving an exact control of the volume flow. At the same time, the great leakage interval leads to a minimum of sheer forces on the liquid and, when the liquid is a paint, leads to an easy cleaning of the equipment when changing color.

According to another preferred embodiment of the invention the device is adapted for feeding water-borne paint. The advantages of the device in feeding such a paint appear clearly from the discussion above.

According to another preferred embodiment of the invention the device is adapted to be arranged in a paint spraying robot with the displacement pump type member in the region of the spray nozzle. It is exactly this very advantageous location of the displacement pump type member that is made possible by the invention and leads to a possibility to save paint.

The present invention also relates to a method. The advantages of the method are apparent in the discussion of the different preferred embodiments of the device according to the invention.

Further advantages and advantageous characteristics of the invention appear from the following description.

BRIEF DESCRIPTION OF THE DRAWINGS

With reference to the appended drawings, below follows a description of preferred embodiments of the invention cited as examples.

In the drawings.

DETAILED DESCRIPTION OF PREFERRED EMBODIMENTS OF THE INVENTION

Figure 1:
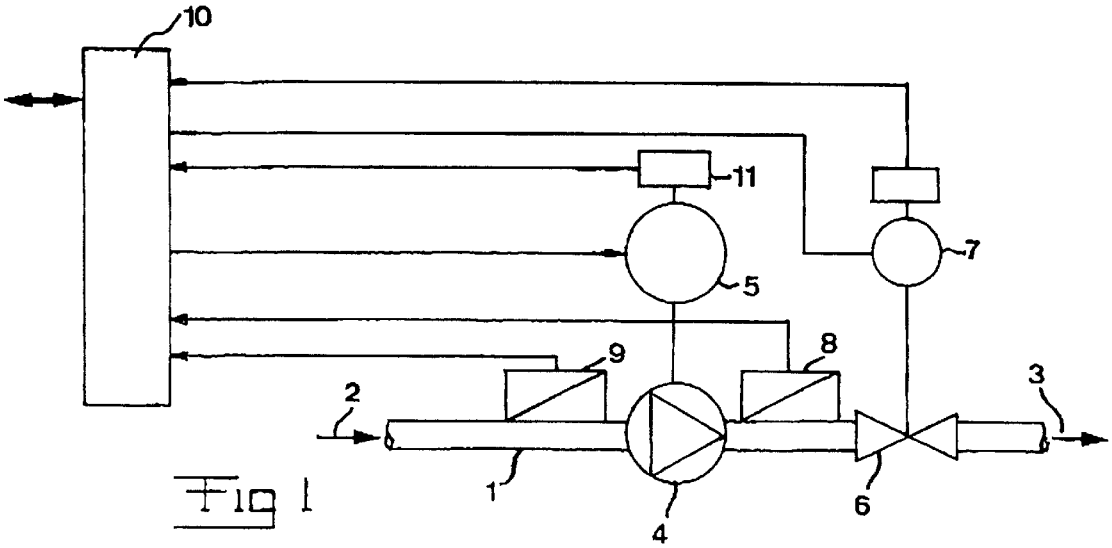
FIG. 1 is a schematic block diagram illustrating the principle according to which a device according to a preferred embodiment of the invention is intended to function.

The general function of a device according to a preferred embodiment of the invention is very schematically illustrated in FIG. 1. This device may advantageously be used for feeding a controlled volume flow of paint to a spray nozzle for automatic spray painting through a robot, for example for painting vehicle bodies. The device has a conduit 1 for conducting the paint under pressure from a paint source (not shown) located upstream of the arrow 2, to a spray nozzle not shown located downstream of the arrow 3 for spraying the paint onto an object. The paint source and the pump (not shown in FIG. 1) for feeding the paint in the conduit 1 may be located at a considerable distance upstream of the spray nozzle if so desired. This pump does not have to be able to deliver a controllable exact volume flow for reasons set forth further below.

The device further includes a displacement pump type member 4 arranged in the conduit 1. The pump 4 is here in the form of a modified gear pump. The construction of the pump will be explained further below with reference to FIGS. 2 and 3.

The driving means 5 in the form of a small electric motor with a very exactly adjustable rotation speed is arranged to drive the movable parts of the member of displacement pump type, i.e. the gear wheels thereof, with a speed determined by a certain volume flow through the conduit. A valve means 6 is further arranged in the conduit. The device also comprises means 7 adapted to regulate the volume flow through the conduit by regulating the throttling degree of the valve means.

The device has also a first means 8 adapted to measure the pressure of the flow in the conduit 1 downstream of the member 4 of displacement pump type as well as a second means 9 adapted to measure the pressure of the flow in the conduit upstream of the member of displacement pump type. The two measuring means are adapted to send signals about the magnitude of the pressures measured to an arrangement 10 adapted to compare these pressure values measured. On the basis of this comparison the arrangment 10 sends control signals to the regulating means 7 for influencing the valve means 6 for regulating the flow through the conduit 1, so that the difference between the pressure values measured by the measuring means 8 and 9 comes to a minimum.

In this state of the device, the volume flow in the conduit 1 is substantially the same as if the member of displacement pump type was not there at all, and the rotation speed of the gear wheels of the member of displacement pump type is a direct measure or value of the volume flow through the conduit.

A means 11 adapted to give the reference positions of the motor 5 and the gear wheels to the arrangement 10 is shown in FIG. 1. This arrangement can then by integration of the known speed of the motor calculate the instant position of the gear wheels with a high time resolution between every pulse from the means 11. This is used for a good demodulation of the pressure variations from the measuring means 8 and 9 and for controlling the speed of the motor.

Figure 2:
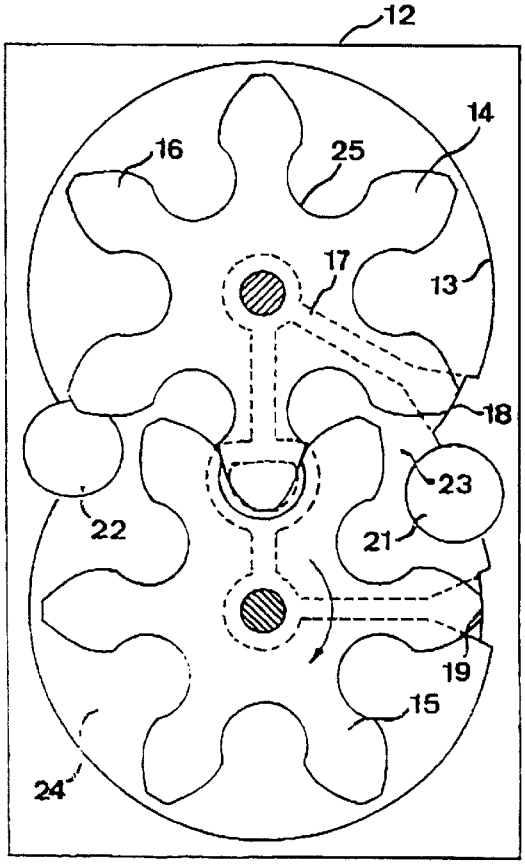
FIG. 2 is a detail view of a member of displacement pump type being a part of the device according to FIG. 1 in a first position sealing the inlet chamber with respect to the outlet chamber.
Figure 3:
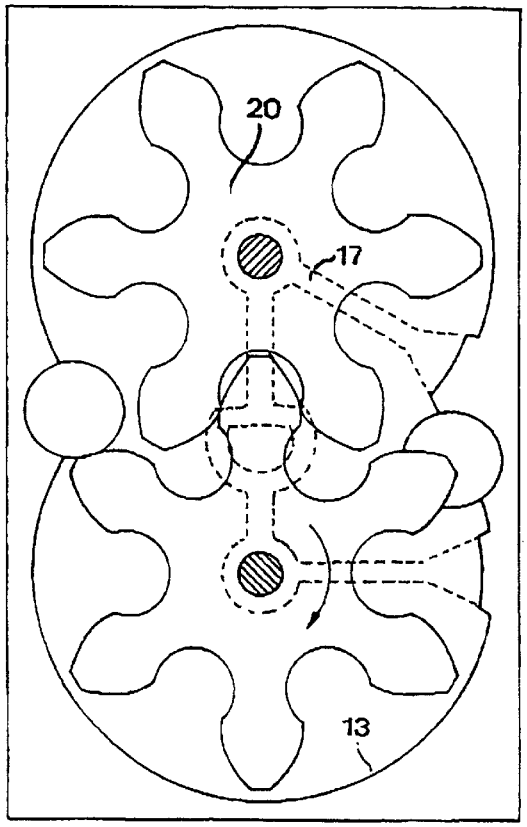
FIG. 3 is a view corresponding to FIG. 2 of the member of displacement pump type in a position allowing leakage between the inlet and outlet chambers.

The structure of the displacement pump type member is shown more in detail in FIGS. 2 and 3. This member may be small and light, since it does not have the task of propelling any paint. However, the gear wheels thereof shall only rotate with a speed such that they remain substantially uninfluenced by the flow.

The member is preferably made of plastic for making it light. It has a housing 12 with inner walls 13 that delimit the chamber of the "pump". Two gear wheels 14, 15 are rotary arranged in the housing 12.

One of the gear wheels is driven to rotate by the motor 5. Through tooth meshing, the driven gear drives the other gear to rotate. This means that the two gear wheels will rotate in opposite directions. In the state in FIG. 2, the upper gear will rotate counter-clockwise and the lower gear clockwise.

The inner walls 13 are designed such that the teeth 16 seal against the wall over a limited distance of their movement. This distance coincides substantially with the connection places 18, 19 of a sealing means 17 schematically indicated by dashed lines to the inner wall 13. The sealing means 17 is formed by a sealing rim projecting from the ceiling or the bottom of the pump against the front faces 20 of the gear wheels and bearing tightly against the gear wheels.

The remainer of the front faces 20 of the gear wheels have a distance to the ceiling or floor on which the sealing rim 17 is arranged. This means that paint may leak past the front faces 20 of the gear wheels and the floor or ceiling in all places except from where the sealing rim 17 is arranged. Furthermore, paint may leak through the space between the teeth 14 and the inner walls 13, except from in the vicinity of the places 18 and 19, where the teeth move tightly past the walls. The gear wheels are tight with respect to the house on the opposite side of the gear wheels with respect to the sealing rim.

The places 18 and 19 are located such that the teeth of one of the wheels will move past the place 18 at the same time as the teeth of the other wheel will move past the place 19. The places 18 and 19 extend so far in the circumferential direction that the respective gear wheel has to rotate approximately 20° for making one tooth move past these places. This represents a third of the distance between consecutive teeth. A tightness over 25–40% of the tooth distance has been found suitable.

The member 4 has also an inlet 21 and an outlet 22. An inlet chamber 23 and an outlet chamber 24 are, through the sealing means 17, tightly delimited with respect to each other when the teeth of the gear wheels pass the sealing means 17, as illustrated in FIG. 2. This means that the volume of the inlet chamber 23 will gradually increase during the movement of the gear wheels along the sealing distance, that is, during a rotation of approximately 20 degrees, at the same time as the volume of the outlet chamber 24 is reduced in a corresponding degree and the member 4 then functions as a displacement pump. Now when the pressure is measured upstream and downstream of the member 4 through the measuring means 8 and 9 and the procedure mentioned above for regulating the volume flow through the valve means 6 is carried out, a minimum difference between these pressure values is obtained through an "idling" of the gear wheels without any retardation or acceleration of flow.

The latter circumstance means that the sheer forces exerted by the gear wheels upon the paint will be small. These forces are further reduced by the fact that the paint may in other relative positions between the gear wheels and the connection places 18 and 19 of the sealing means 17 to the wall leak past the sealing means, as for example in the position according to FIG. 3. This does not present any risk for formation of aggregations at spray application of the water-borne paint by means of the device according to the invention. Moreover, it will be easy to clean the equipment by pumping for example a solvent and/or air through the conduit 1, since the member 4 then may be set in a fully leakage position, and bulky bypass-circuits around the member 4 may thereby be avoided. Furthermore, the teeth 16 are designed with a partially rounded shape which is different with respect to the rounded shape of the recesses 25 in the gear wheels between the teeth, so that the teeth fit into each other with a play therebetween. This reduces the risk of the formation of sticky aggregations of paint between the teeth and the preventing of a free rotation of the gear wheels.

Figure 4:
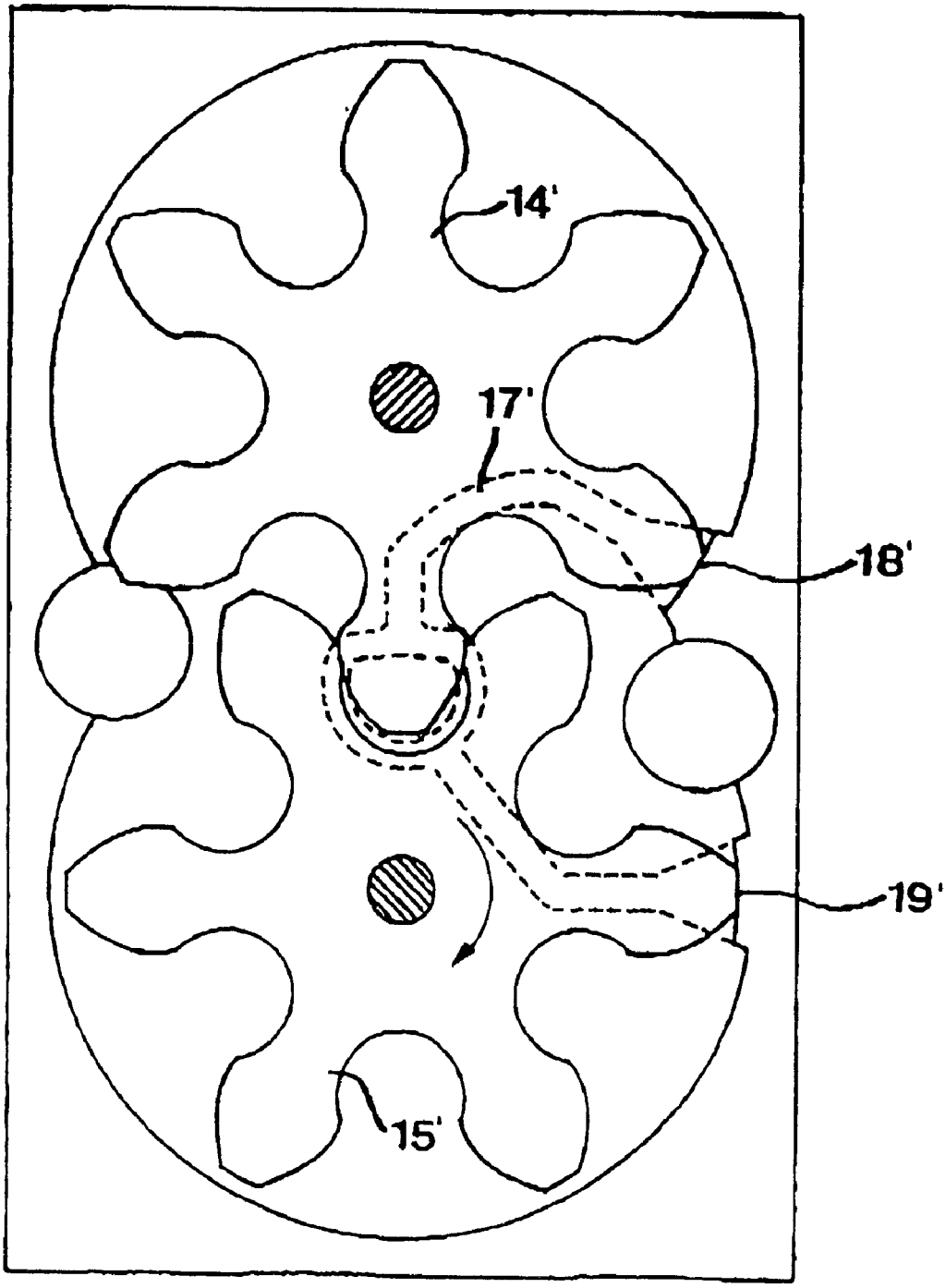
FIG. 4 is a view corresponding to FIG. 2 of a member of displacement pump type according to a second preferred embodiment.

A member of displacement pump type having an alternative "extreme" extension of the sealing means 17' in the sealing position is illustrated in FIG. 4.

The invention is of course not in any way restricted to the preferred embodiment described above, but many possibilities to modifications thereof will be apparent to a man skilled in the art without departing from the basic idea of the invention as this is defined in the claims.

For example the definition in the claims also includes that the comparison arrangement may be realized by a manual reading and comparison of the pressure values delivered by the measuring means and then a manual influence of a regulating means for regulating the throttling degree of the valve.

It would also be conceivable to arrange more than one valve means, and the valve means may also be arranged upstream of the member of displacement pump type.

The member of displacement pump type could have another design, and in an embodiment similar to the one shown in the Figures, the sealing means could have another extension so as to achieve a different relationship between the volumes of the inlet and outlet chambers should this be desired. It would also be conceivable to have another number of gear wheels than two in the member of displacement pump type.

The device could be adapted to feed a liquid other than paint. The liquid could also have a varying viscosity. Also, very high viscosities which are there for some sealing agents being nearly plastic would be conceivable for such a liquid.

What is claimed is:

1. A device for feeding a controlled volume flow of liquid to a spray nozzle for automatic spray application, the device comprising:

a conduit defining a flow path from a liquid source to the spray nozzle;

a displacement pump type member arranged in the conduit;

driving means for driving the displacement pump type member with the movable parts thereof with a speed determined by the actual volume flow through the conduit;

means arranged in the conduit upstream of the displacement pump type member and for supplying the flow of liquid through the conduit to the displacement pump type member and for properly feeding the liquid in the conduit;

a valve means located in the conduit;

means for regulating the volume flow through the conduit by regulating the throttling degree of the valve means;

a first means for measuring the pressure of the flow in the conduit downstream of the displacement pump type member;

a second means for measuring the pressure of the flow in the conduit upstream of the displacement pump type member; and an arrangement for comparing the pressure values delivered by the two measuring means and on the basis of this comparison controlling the regulating means to influence the valve means for obtaining comparison pressure values corresponding to a volume flow predetermined by the choice of the speed of the movable parts of the displacement pump type member.

2. The device according to claim 1, wherein the driving means is formed by a motor with adjustable speed for regulating the speed of the movable parts in the displacement pump type member and thereby the volume flow through the conduit through the influence of the comparison arrangement on the regulating means.

3. The device according to claim 1, wherein the displacement pump type member comprises means for tightly separating an inlet chamber and an outlet chamber of the displacement pump type member over a limited first distance of the movement of the movable parts and allow leakage between the chambers over a second distance of the movement of the movable parts between consecutive first distances.

4. The device according to claim 3, wherein the comparison arrangement compares the pressure values delivered by the measuring means during tightness between the inlet and outlet chambers and controls the regulating means to influence the valve means so that the difference between these values comes to a minimum.

5. The device according to claim 1, wherein the displacement pump type member has the general structure of a gear pump.

6. The device according to claim 5, wherein the displacement pump type member has at least two tooth-like wheels having two mutually meshing members.

7. The device according to claim 3, wherein the first distance with tightness between the inlet and the outlet chambers is shorter than the distance between two consecutive tooth members of the respective wheel.

8. The device according to claim 7, wherein the distance with complete tightness corresponds to 25–40% of the tooth distance.

9. The device according to claim 6, wherein each wheel has less than ten tooth members.

10. The device according to claim 6, wherein the tooth members of the two wheels fit into each other with a play therebetween.

11. The device according to claim 10, wherein the tooth members have a partially rounded end shape, and the wheels include recesses for receiving tooth members of the other wheel, the recessing have a rounded shape differing from the shape of the tooth members.

12. The device according to claim 3, further comprising:

a housing for receiving the two wheels, the housing comprising surrounding walls, wherein the two wheels are arranged with front faces thereof at a distance from at least one of a ceiling and a floor of the housing except from along a line formed by the means for tightly separating an inlet chamber and an outlet chamber of the displacement pump type member and ending at a place on the wall surrounding one of the gear wheels and at another place at the wall surrounding the other of the gear wheels.

13. The device according to claim 12, wherein the tooth members seal against the walls of the housing only upon passing places defined by the sealing member.

14. The device according to claim 1, wherein the device feeds water-borne paint.

15. The device according to claim 1, further comprising:

a paint spraying robot, wherein the displacement pump type member is arranged in the region of the spray nozzle.

16. A method for feeding a controlled volume flow of liquid to a spray nozzle for automatic spray application, the method comprising:

arranging a displacement pump type member in a conduit defining a flow path from a liquid source to the spray nozzle;

driving the displacement pump type member with movable parts thereof with a determined speed;

feeding a flow of liquid through the conduit to the displacement pump type member and further on to the spray nozzle by influencing the liquid in the conduit upstream of a member of displacement pump type;

regulating the volume flow in the conduit through regulating the throttling degree of a valve means located in the conduit;

measuring the pressure of the flow in the conduit upstream and downstream of the displacement pump type member;

comparing the measured pressure values; and adjusting a degree of throttling of the valve means based on a result of the comparison to obtain comparison values corresponding to a volume flow predetermined by a choice of a speed of movable parts of the displacement pump type member.

17. The method according to claim 16, wherein the speed of the movable parts of the displacement pump type member is adjusted to regulate the volume flow through the conduit through the comparison.

18. The method according to claim 16, further comprising:

opening for leakage between an inlet and an outlet chamber of the displacement pump type member during certain parts of the movement of the movable parts.

19. The method according to claim 16, wherein a water-borne paint is fed through the conduit to the spray nozzle.

* * * * *